US008460124B2

(12) United States Patent
Nagasawa et al.

(10) Patent No.: US 8,460,124 B2
(45) Date of Patent: Jun. 11, 2013

(54) COLORED GOLF BALL

(75) Inventors: Hiroyuki Nagasawa, Saitama-ken (JP); Satoshi Matsuda, Saitama-ken (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 853 days.

(21) Appl. No.: 12/487,096

(22) Filed: Jun. 18, 2009

(65) Prior Publication Data

US 2010/0261550 A1 Oct. 14, 2010

(30) Foreign Application Priority Data

Apr. 13, 2009 (JP) ..... 2009-097060

(51) Int. Cl.
*A63B 37/06* (2006.01)

(52) U.S. Cl.
USPC ..... 473/378

(58) Field of Classification Search
USPC ..... 473/378, 351
See application file for complete search history.

(56) References Cited

U.S. PATENT DOCUMENTS

| | | | | |
|---|---|---|---|---|
| 6,022,279 | A | 2/2000 | Yamagishi et al. | |
| 6,435,984 | B1 * | 8/2002 | Ohama | 473/377 |
| 6,561,923 | B1 | 5/2003 | Ohama et al. | |
| 6,569,037 | B2 | 5/2003 | Ichikawa et al. | |
| 7,568,986 | B2 | 8/2009 | Watanabe et al. | |
| 7,951,526 | B2 | 5/2011 | Hayashi | |
| 7,999,019 | B2 | 8/2011 | Nakamura et al. | |
| 2005/0009640 | A1 * | 1/2005 | Isogawa et al. | 473/371 |
| 2009/0054176 | A1 | 2/2009 | Isogawa et al. | |
| 2009/0075758 | A1 | 3/2009 | Nakamura et al. | |
| 2012/0015763 | A1 | 1/2012 | Isogawa et al. | |

FOREIGN PATENT DOCUMENTS

| | | | |
|---|---|---|---|
| JP | 10-155937 | A | 6/1998 |
| JP | 2000-024139 | A | 1/2000 |
| JP | 2000-254250 | A | 9/2000 |
| JP | 2002-143345 | A | 5/2002 |
| JP | 2003-126299 | A | 5/2003 |
| JP | 2004-033594 | A | 2/2004 |
| JP | 2004-081350 | A | 3/2004 |
| JP | 2007-144097 | A | 6/2007 |
| JP | 2009-034504 | A | 2/2009 |
| JP | 2009-045347 | A | 3/2009 |
| JP | 2009-066241 | A | 4/2009 |
| JP | 2009-066255 | A | 4/2009 |
| WO | 2006/121172 | A1 | 11/2006 |

OTHER PUBLICATIONS

Japanese Office Action issued on Oct. 24, 2012 from the Japanese Patent Office in Japanese Application No. 2009-097060.

* cited by examiner

*Primary Examiner* — Raeann Gorden
(74) *Attorney, Agent, or Firm* — Sughrue Mion, PLLC

(57) ABSTRACT

In a golf ball composed of a core, a cover of at least one layer encasing the core, and a coat of paint applied to a surface of an outermost layer of the cover, the outermost layer of the cover or the coat of paint is colored with a fluorescent pigment. The ball has a color tone, at a measurement area diameter of 5 mm in a method of measuring the color of a reflecting object according to JIS Z-8722, which satisfies specific conditions in the Lab color system. The ball is endowed with an excellent spin performance and durability, an appearance characterized by outstanding visibility, stylishness and luxury, and an excellent weather resistance.

15 Claims, 1 Drawing Sheet

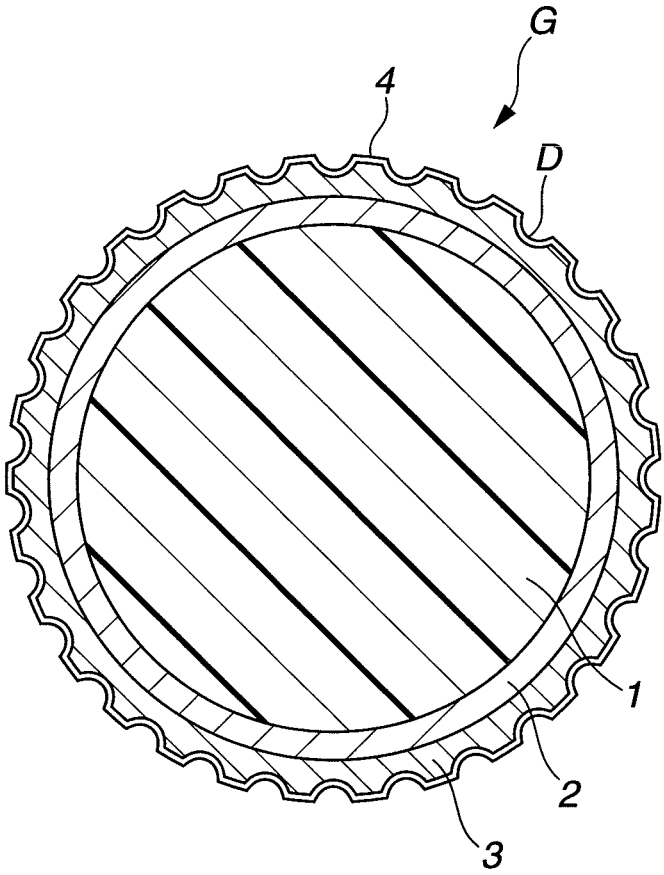
G
4
D
1
2
3

COLORED GOLF BALL

CROSS-REFERENCE TO RELATED APPLICATION

This non-provisional application claims priority under 35 U.S.C. §119(a) on Patent Application No. 2009-097060 filed in Japan on Apr. 13, 2009, the entire contents of which are hereby incorporated by reference.

BACKGROUND OF THE INVENTION

1. Field of the Invention

The present invention relates to a colored golf ball having a fluorescent color. More specifically, the invention relates to a colored golf ball endowed with an excellent spin performance and durability, an appearance characterized by outstanding visibility, stylishness and luxury, and an excellent weather resistance.

2. Prior Art

Lately, not all golf balls are white; a variety of colored balls have appeared on the market in response to the preferences of golfers. In particular, highly stylish colored golf balls and colored golf balls endowed with a luxury have been developed to suit the tastes of women golfers.

At the same time, with the increasing versatility of golf balls in recent years, adopting a ball construction of at least three pieces—namely, a core, an intermediate layer and a cover—is becoming a precondition for the creation of golf balls acceptable to the skilled golfer. In multi-piece solid golf balls composed of three or more pieces, the sensory impression elicited by the ball varies with differences in the thicknesses and colors of the respective layers. Moreover, in addition to ball performance, from a psychological standpoint, using a golf ball having a favorite color imparts a beneficial psychological effect on the golfer, improving performance by the golfer. Yet, few colored golf balls for the skilled golfer which take such factors into account, particularly colored golf balls with an outermost cover layer made of a polyurethane material, are available on the market.

JP-A 10-155937 discloses a golf ball colored in shades other than white. Expressing the color tone of this ball in the Lab color system, the cover is given a blue, green, pink, yellow or orange color having an L value of at least 80, an a value of from −30 to +30, and a b value of from −30 to +30. Although this golf ball is more stylish than earlier colored golf balls, the colors within these ranges are pale colors, as a result of which the ball lacks a bright coloration and a high-quality feel. There is also room for improvement in achieving further stylishness.

JP-A 2000-024139 describes a golf ball in which the cover-forming material includes from 3.0 to 7.0 parts by weight of one or more type of fluorescent pigment and from 0.05 to 0.5 part by weight of titanium oxide per 100 parts by weight of resin, and which has one or more coat of clear paint on the cover. However, given that the amount of fluorescent pigment included is somewhat high and that from 0.05 to 0.5 part by weight of titanium oxide is additionally combined therewith, the color tends to be too intense, in addition to which the ball is somewhat lacking in luminosity. As a result, although this prior-art ball does have an excellent visibility, it falls a bit short in terms of the luxury.

JP-A 2000-254250 teaches a brightly colored golf ball of good visibility which has at least one colored layer containing a white organic pigment and/or white inorganic pigment, a fluorescent pigment, and an inorganic pigment and/or organic pigment. However, this golf ball has a pale color tone, and thus leaves something to be desired in terms of the luxury and brightness of color.

JP-A 2003-126299 discloses a golf ball of a bright yellow color which, even under harsh usage conditions, is not readily subject to fading or discoloration and has an excellent weather resistance. This golf ball, although brightly colored and having an excellent weather resistance, exhibits a rather deep yellow color which, unfortunately, is a color tone that falls short in terms of the luxury.

JP-2004-081350 describes a painted golf ball in which a coat of paint containing a polarizing pigment has been formed on the surface of a golf ball body. The paint also contains a non-white colorant. The surface of the golf ball body is imparted with a color other than white, and has a lightness L* value, based on the L*a*b* color system, of 50 or less. However, this golf ball does not have a sufficient lightness, and falls somewhat short in terms of stylishness and visibility.

JP-A 2004-033594 discloses a golf ball which is colored blue, pink or yellow, and which has an excellent visibility without being visually disconcerting. The L, a and b values are described as satisfying a specific formula. Even though this golf ball does indeed have an excellent visibility without being visually disconcerting, there remains room for improvement in such attributes as the brightness and luxury.

JP-A 2007-144097 describes a golf ball of enhanced visibility wherein the cover is formed of a cover material composed of a transparent resin composition to which has been added a fluorescent dye. Although this golf ball does indeed achieve a relatively vivid color tone, when a fluorescent dye is used, color changes such as fading tend to arise with the passage of time and exposure to the weather. Accordingly, here too, there remains room for further improvement.

SUMMARY OF THE INVENTION

It is therefore an object of the present invention to provide a colored golf ball which has excellent spin performance and durability, an appearance characterized by outstanding visibility, stylishness and luxury, and an excellent weather resistance.

The inventors have discovered that golf balls having a core, a cover of at least one layer encasing the core, and a coat of paint applied to a surface of an outermost cover layer which is preferably formed of polyurethane, wherein the outermost cover layer and/or the coat of paint is colored with a fluorescent pigment and the ball itself has a color tone, at a measurement area diameter of 5 mm in a method of measuring the color of a reflecting object according to JIS Z-8722, which satisfies specific ranges in the Lab color system are endowed with an excellent spin performance and durability, an appearance characterized by outstanding visibility, stylishness and a luxury, and an excellent weather resistance.

Accordingly, the present invention provides a golf ball composed of a core, a cover of at least one layer encasing the core, and a coat of paint applied to a surface of an outermost layer of the cover. The outermost cover layer or the coat of paint or both is colored with a fluorescent pigment. The ball itself has a color tone, at a measurement area diameter of 5 mm in a method of measuring the color of a reflecting object according to JIS Z-8722, which, expressed in the Lab color system, satisfies the conditions $30 \leqq L$, $-40 \leqq a \leqq 60$, and $-20 \leqq b \leqq 60$.

In one embodiment, the fluorescent pigment in the outermost cover layer and/or the coat of paint is an orange fluorescent pigment, and the color tone of the ball, expressed in the Lab color system, satisfies the conditions $40 \leqq L$, $-10 \leqq a \leqq 60$, and $0 \leqq b \leqq 50$. In another embodiment, the fluorescent pigment in the outermost cover layer and/or the coat of paint is a pink fluorescent pigment, and the color tone of the ball, expressed in the Lab color system, satisfies the conditions $30 \leqq L$, $10 \leqq a \leqq 60$, and $-20 \leqq b \leqq 10$. In yet another embodiment, the fluorescent pigment in the outermost cover layer and/or the coat of paint is a yellow fluorescent pigment, and the color tone of the ball, expressed in the Lab color system, satisfies the conditions $40 \leqq L$, $-40 \leqq a \leqq 0$, and $10 \leqq b \leqq 60$.

The outermost cover layer of the golf ball is preferably made of a resin selected from the group consisting of thermoset polyurethanes, thermoplastic polyurethanes and reaction injection-molded polyurethanes. The outermost cover layer is more preferably made of a thermoplastic polyurethane, particularly a thermoplastic polyurethane which includes as a component therein an aromatic polyisocyanate.

It is advantageous for the outermost cover layer to be colored with a fluorescent pigment and to be composed of 100 parts by weight of a base resin and from 0.05 to 2.5 parts by weight of at least one type of fluorescent pigment resin. The fluorescent pigment in the outermost cover layer is preferably an organic fluorescent pigment obtained by coloring an amino base resin or an acrylic base resin with a dye selected from the group consisting of xanthene, acridine, quinoline, thiazole and aminoketone dyes.

In a further embodiment of the inventive golf ball, the core or an intermediate spherical body composed of the core and at least one cover layer encasing the core is either a white colored sphere or a white colored sphere encased by a clear resin layer having a thickness of from 0.5 to 2.5 mm; the core or the intermediate spherical body has a color tone, at a measurement area diameter of 5 mm, which, expressed in the Lab color system, satisfies the conditions $40 \leqq L$, $-5 \leqq a \leqq 5$, and $-5 \leqq b \leqq 5$; and the intermediate spherical body is encased by an outermost cover layer having a thickness of from 0.3 to 2.0 mm.

In a still further embodiment, the core or an intermediate spherical body composed of the core and at least one cover layer encasing the core is either a sphere colored the similar color as the outer cover layer or coat of paint colored by the fluorescent pigment or a sphere colored the similar color as the outer cover layer or coat of paint and encased by a clear resin layer having a thickness of from 0.5 to 2.5 mm; the core or the intermediate spherical body has a color tone, at a measurement area diameter of 5 mm, with a color difference $\Delta E$ relative to the color tone of the outer cover layer or coat of paint which, expressed in the Lab color system, is less than 15; and the intermediate spherical body is encased by an outermost cover layer having a thickness of from 0.3 to 2.0 mm.

The golf ball may have a color tone at a measurement area diameter of 5 mm and a color tone at a measurement area diameter of 30 mm, such that the color difference $\Delta E$ therebetween is greater than 10. Alternatively, the golf ball may have a change in color $\Delta E$ after 24 hours of irradiation with a mercury vapor lamp of at most 8, or may have a discoloration difference ($\Delta YI$), based on the reflection method of JIS-K7103, before and after 24 hours of irradiation with a mercury vapor lamp, of at least −10 but not more than 10.

The coat of paint applied to the outermost layer of the golf ball may be composed of 100 parts by weight of a base resin composition and preferably from 0.1 to 10 parts by weight, more preferably from 0.2 to 8 parts by weight, of a polarizing pigment.

The golf ball of the invention has an excellent spin performance and durability, an appearance characterized by outstanding visibility, stylishness and luxury, and an excellent weather resistance. By employing in particular a polyurethane material in the outermost cover layer, the resulting ball will be endowed with the excellent spin performance and durability desired by skilled golfers. At the same time, unlike the white coloration of conventional golf balls, the inventive balls have an appearance with outstanding stylishness and luxury, and also have an excellent visibility, making it possible for the golfer to differentiate herself or himself from other golfers.

BRIEF DESCRIPTION OF THE DIAGRAMS

FIG. 1 is a schematic cross-sectional view of a golf ball according to one embodiment of the present invention.

DETAILED DESCRIPTION OF THE INVENTION

The objects, features and advantages of the invention will become more apparent from the following detailed description, taken in conjunction with the foregoing diagram.

The inventive ball has a construction which includes a core, a cover of one or more layer that encases the core, and a coat of paint applied to a surface of the outermost cover layer. Numerous dimples are generally formed on the surface of the cover. For example, the cross-sectional view of a ball in FIG. 1 shows a three-piece golf ball G having a core 1 encased by a cover, which cover is formed of two layers: an intermediate layer 2 and an outermost layer 3. A plurality of dimples D are formed on the surface of the outermost layer 3. By having the cover composed of three or more layers, a multi-piece solid golf ball of four or more pieces can be achieved. Also, the core 1 may be composed of a single layer or of two or more layers. In addition, a coat of paint 4 is formed on the outermost layer 3 so as to cover the surface of the ball.

The core used in the invention may be obtained by vulcanizing a rubber composition prepared by blending a known rubber material such as 1,4-cis polybutadiene as the base together with a co-crosslinking agent (e.g., unsaturated carboxylic acids and metal salts thereof), an inorganic filler (e.g., zinc oxide and barium sulfate) and an organic peroxide (e.g., dicumyl peroxide and 1,1-bis(t-butylperoxy)-cyclohexane). In the present invention, no particular limitation is imposed on the core diameter. Nor is any particular limitation imposed on the color of the core.

The cover material used in the present invention may be formed primarily of a resin material which is any of various thermoplastic resins such as ionomer resins and polyurethane, or is a thermoplastic elastomer.

As noted above, the cover may be formed of a single layer or of two or more layers. Each layer of the cover has a thickness which, while not subject to any particular limitation, is preferably at least 0.3 mm, more preferably at least 0.4 mm, and even more preferably at least 0.5 mm, but preferably not more than 2.5 mm, more preferably not more than 2.0 mm, and even more preferably not more than 1.5 mm. In cases where the cover has two layers, i.e., includes an outermost layer and an intermediate layer, the combined thickness thereof is preferably from 0.8 to 3.0 mm.

When the cover is formed of two layers, various types of adhesives (primers) may be applied to improve adhesion between the intermediate layer and the outermost layer.

Of the cover layers, it is preferable for the outermost layer to be formed primarily of a polyurethane material. Various types of urethane resins may be used, including thermoset polyurethanes, thermoplastic polyurethanes and reaction injection-molded polyurethanes. However, the use of thermoplastic polyurethanes is especially preferred on account of their high productivity and high degree of freedom of coloration, and also their high degree of freedom in compounding and designing blends or alloys thereof with various inorganic and/or organic fillers and with polymers other than urethane materials. Here, including an aromatic polyisocyanate component within the thermoplastic polyurethane is desirable for achieving a good balance between stability at the time of production and the physical properties that are manifested. By using a polyurethane material in the outermost layer, it is possible to achieve a golf ball which has an outstanding stylishness and luxury while at the same time exhibiting the spin performance and durability desired by skilled golfers.

The base resin of the outermost layer is preferably made transparent or semi-transparent in order to enhance the stylishness of the ball. In the present invention, a fluorescent pigment may also be mixed into this resin base. The amount of fluorescent pigment included, while not subject to any particular limitation, is preferably from 0.01 to 10 parts by weight, more preferably from 0.02 to 5 parts by weight, and even more preferably from 0.05 to 2.5 parts by weight, per 100 parts by weight of the base resin. If the amount of fluorescent pigment included is too low, it may not be possible to achieve a color tone having fluorescence. On the other hand, if the amount of fluorescent pigment included is too high, although the fluorescence will increase and the ball will have an excellent visibility, the color of the ball will be too vivid, diminishing the luxury, which may make the color unacceptable to the golfer.

The type of fluorescent pigment formulated in the cover is not subject to any particular limitation. However, it is preferable to use an organic fluorescent pigment obtained by the coloration of an amino base resin or acrylic base resin with a dye selected from the group consisting of xanthene (red/pink) dyes, acridine (yellow) dyes, quinoline (yellow) dyes, thiazole (yellow) dyes and aminoketone (yellow) dyes.

The use of an organic fluorescent pigment as the above fluorescent pigment is preferred. Organic fluorescent pigments are characterized by bright, vivid hues, and have the advantage that they emit light in the presence of sunlight. Unlike inorganic fluorescent substances, they do not require an ultraviolet lamp, for example. An inorganic filler may be included together with the fluorescent pigment. The inorganic filler scatters and diffuses light, enabling the visibility to be improved even further. Examples of suitable inorganic fillers include aluminum hydroxide, calcium carbonate and titanium oxide.

The method used to color the cover outermost layer with the fluorescent pigment may involve blending a fluorescent pigment in the state of a finely divided powder into the cover-forming resin material so as to give a colored resin. Alternatively, to improve dispersibility and workability, the fluorescent pigment and a component serving as an aggregate may first be blended together to form a colorant, a suitable amount of which may then be incorporated within the cover resin.

A plurality of dimples are formed on the surface of the outermost layer of the cover. The dimples have numerous topographic features on the surface of the outermost layer and, by virtue of their diameter, number and depth, exert an influence on the appearance of the ball. Accordingly, it is preferable for the dimples to be configured in a manner that allows the objects of the invention to be attained. The number of such dimples, while not subject to any particular limitation, is preferably at least 250 but not more than 330. The dimples formed on the surface of the ball have a surface coverage (SR) which, while not subject to any particular limitation, is preferably at least 80%, and more preferably at least 90%, but preferably not more than 98%, and more preferably not more than 95%. For example, if the number of dimples is too large, when light strikes the ball, the visibility effect of the colored ball may diminish. That is, depending on the angle from which the ball is viewed, shadows will form in the bottoms of the dimples, which may cause the ball to appear darker. On the other hand, if the number of dimples is too small, good aerodynamic properties cannot be obtained when the ball is hit, as a result of which the ball may not travel the desired distance.

The method of manufacturing a sphere having the above-described cover may involve molding and vulcanizing a rubber composition composed primarily of polybutadiene or the like under known vulcanization conditions to form a crosslinked rubber molding (core), then successively molding the one or more cover layer (e.g., intermediate layer and outermost layer) over the core by a known method such as injection molding to produce the golf ball. Also, given that a large number of dimples are generally formed on the ball surface, when the cover material is injection-molded to form the outermost layer, the dimples are formed at the same time by a plurality of projections provided on the inner wall of the mold cavity.

As shown in FIG. 1, the surface of the outermost layer of the cover is covered by a coat of paint 4. This paint coat 4 has a thickness which, while not subject to any particular limitation, is preferably at least 5 μm, and more preferably at least 10 μm, but preferably not more than 20 μm, and more preferably not more than 16 μm. If the coat of paint is too thin, the paint may have a poor durability. On the other hand, if the coat of paint is too thick, the paint may have a large effect on the dimple shape, which may make it impossible to obtain flight properties according to design and may thus result in the ball traveling a less than desirable distance. Also, if the coat of paint is too thick, peeling of the paint tends to arise, which may lower the durability of the ball to repeated impact.

When the coat of paint is formed by clear coating (coating with a clear paint), it is preferable to use a two-component curing urethane paint for this purpose. The two-component curing urethane paint is composed of a polyol component having hydroxyl groups and a polyisocyanate component having isocyanate groups.

Examples of polyols that may be primarily used include urethanes, polyesters and acrylic resins, although other resins, including epoxy resins, may be employed if necessary. Examples of polyisocyanates that may be used include tolylene diisocyanate (TDI), diphenylmethane-4,4'-diisocyanate (MDI), hexamethylene diisocyanate (HDI), isophorone diisocyanate (IPDI), naphthalene diisocyanate (NDI), 1,4-phenylene diisocyanate (PDI), xylylene diisocyanate (XDI) and hydrogenated xylylene diisocyanate (HXDI), either singly or in modified forms as combinations thereof. The polyisocyanate component may generally take the form of an adduct, a biuret or an isocyanurate.

Any known method used in the art may be employed as the coating method. For example, the ball may be perched on the tips of needles on a needle bed, and the entire ball coated with various types of coatings by spraying. Prior to coating, any of a variety of techniques may be used to improve adhesion between the object to be coated and the coat of paint; illustrative, non-limiting examples of such techniques include surface modification by plasma treatment or corona discharge treatment, and the application of a primer.

The coat of paint in the present invention may include a fluorescent pigment. In cases where a fluorescent pigment is used in the coat of paint, a fluorescent pigment of the same type as that used in the cover outermost layer described above may be employed. When a fluorescent pigment is included in the coat of paint, the amount of fluorescent pigment used per 100 parts by weight of paint film solids is in a range of preferably from 1 to 100 parts by weight, and more preferably from 10 to 80 parts by weight. If the amount of fluorescent pigment included is too low, the paint film hiding power may be poor, making it impossible to achieve the desired coloration. On the other hand, if the amount of fluorescent pigment included is too high, certain properties of the paint film such as durability will be diminished. In cases where a coat of paint that has been colored with a fluorescent pigment is to be applied, if necessary, a coat of primer or sealer may be applied prior to applying the coat of colored paint.

Another embodiment of the coat of paint, although not shown in the appended diagram, involves spraying on or otherwise applying a fluorescent pigment-containing colored material to the dimple-bearing surface of the cover outermost layer, then applying thereon a coating such as a conventional clear coating, so as to form a coat of colored paint. In such a case, the coat of paint will be composed of two layers—a very thin, colored layer and a clear coat.

Generally, in the paint, various solvents and additives are suitably added to the above-described base resin. In addition, a polarizing pigment may be included. When a polarizing pigment is used, it is advantageous to include from 0.05 to 0.5 part by weight of a fluorescent whitener and from 0.1 to 10 parts by weight, preferably 0.2 to 8 parts by weight, of the polarizing pigment per 100 parts by weight of the base resin. If the amount of polarizing pigment included is too low, brightness cannot be manifested at the surface of the ball. On the other hand, if the amount of polarizing pigment included is too high, mutual interference of the light may occur, resulting in a loss of brightness. Excessive polarizing pigment may also alter the spin performance of the ball or cause the coat of paint to peel. In addition, because polarizing pigments are generally expensive, including more than a suitable amount merely leads to an unnecessary rise in cost. Also, light-shifting pigments tend to settle in the paint material prior to curing, which may cause productivity in the paint coating step to worsen. It is preferable for the fluorescent whitener and the polarizing pigment to be used in such a way that the weight ratio therebetween (fluorescent whitener/polarizing pigment) is from 0.08 to 0.5. Adjusting the ratio of fluorescent whitener to polarizing pigment is important for bringing out the luminosity and brightness of the ball. If the fluorescent whitener and the polarizing pigment are added in amounts that are inappropriate, the ball may not have a suitable luminosity, as a result of which the objects of the invention may not be achieved.

A pearlescent pigment may be suitably used as the polarizing pigment. Pearlescent pigments are broadly divided into metal oxide-coated micas, basic lead carbonate, bismuth oxychloride and natural pearl essence. Of these, the selection of a metal oxide-coated mica is preferred because such pigments are nontoxic and have the best chemical stability. Titanium dioxide or iron oxide is typically used as the metal oxide; by varying the coverage (thickness of the coating layer), various colors and interference effects can be achieved. The larger the particle size of these pigments, the greater the degree of brightness that can be achieved. However, at a larger pigment particle size, the brightness tends to subside. Hence, it is desirable to select a pigment having a suitable particle size.

In a golf ball having a coat of paint formed of a paint that contains such a pearlescent pigment, because light can be reflected at various angles, the luxury is increased. Moreover, sunlight is fully reflected, making the golf ball easier to find.

In the present invention, the ball is characterized by having a color tone, at a measurement area diameter of 5 mm in a method of measuring the color of a reflecting object according to JIS Z-8722 (2000), which, expressed in the Lab color system, satisfies the conditions $30 \leqq L$, $-40 \leqq a \leqq 60$, and $-20 \leqq b \leqq 60$. These color test evaluations may be carried out using a measurement area diameter of 30 mm in order to collect data for a broader region. Regarding the difference between measurement area diameters of 5 mm and 30 mm, the greater the difference in color tone that exists between a diameter of 5 mm and a diameter of 30 mm, the better the brightness and visibility of the golf ball. In particular, given that the invention concerns a golf ball, which is an object having a small diameter, in order to impart an unprecedented luxury and visibility capable of being manifested from the color tone of this small ball, it is necessary to comprehensively assess the color of the ball by measuring the color tone at not only a measurement area diameter of 30 mm, but also a small measurement area diameter of 5 mm. Specifically, it is desirable for the difference $\Delta E$ between the color tone of the ball at a measurement area diameter of 5 mm and the color tone of the ball at a measurement area diameter of 30 mm to be larger than 10.

When the fluorescent pigment included in the outermost cover layer and/or the coat of paint is an orange fluorescent pigment, the color tone of the golf ball, expressed in the Lab color system, preferably satisfies the conditions $40 \leqq L$, $-10 \leqq a \leqq 60$, and $0 \leqq b \leqq 50$. When the fluorescent pigment included in the outermost cover layer and/or the coat of paint is a pink fluorescent pigment, the color tone of the golf ball, expressed in the Lab color system, preferably satisfies the conditions $30 \leqq L$, $10 \leqq a \leqq 60$, and $-20 \leqq b \leqq 10$.

When the fluorescent pigment included in the outermost cover layer and/or the coat of paint is a yellow fluorescent pigment, the color tone of the golf ball, expressed in the Lab color system, preferably satisfies the conditions $40 \leqq L$, $-40 \leqq a \leqq 0$, and $10 \leqq b \leqq 60$.

An embodiment that makes effective use of specific advantages of the present invention is a golf ball wherein the core or an intermediate spherical body composed of the core and at least one cover layer encasing the core is either a white colored sphere or a white colored sphere encased by a clear resin layer having a thickness of from 0.5 to 2.5 mm; the core or the intermediate spherical body has a color tone, at a measurement area diameter of 5 mm, which, expressed in the Lab color system, satisfies the conditions $40 \leqq L$, $-5 \leqq a \leqq 5$, and $-5 \leqq b \leqq 5$; and the intermediate spherical body is encased by an outermost cover layer having a thickness of from 0.3 to 2.0 mm. Alternatively, the core or the intermediate spherical body composed of the core and at least one cover layer encasing the core is a sphere colored with the similar color as the outer cover layer or coat of paint colored by a fluorescent pigment or a sphere colored the similar color as the outer cover layer or coat of paint and encased by a clear resin layer having a thickness of from 0.5 to 2.5 mm; the core or the intermediate spherical body has a color tone, at a measurement area diameter of 5 mm, with a color difference $\Delta E$ relative to the color tone of the outer cover layer or the coat of paint, which, expressed in the Lab color system, is less than 15; and the intermediate spherical body is encased by an outermost cover layer having a thickness of from 0.3 to 2.0 mm.

Also, in the present invention, it is preferable for the ball to undergo a change of color $\Delta E$, when irradiated for 24 hours with a mercury vapor lamp, of 8 or less. This change of color, or color difference, $\Delta E$ is the difference in color between the ball prior to irradiation and the ball after 24 hours of irradiation; a smaller value indicates less change in color. Measurement of this color difference $\Delta E$ for the ball may be carried out using a known color difference meter, based on the criteria of JIS Z 8701 (1999).

Also, given that ready discoloration due to ultraviolet light is undesirable for the surface of a golf ball, it is recommended that, as a measure of yellowing resistance, when the surface of a golf ball is irradiated for 24 hours with a mercury vapor lamp, the discoloration difference ($\Delta YI$), based on the reflection method of JIS-K7103, between the golf ball surface following irradiation and the golf ball surface prior to irradiation, be at least −10 but not more than 10.

The color of the ball may be used to distinguish between, based on consumer color preference and self-image, balls for men and balls for women or, from the standpoint of ball performance, between distance balls and spin balls. Providing colored golf balls is generally also an effective strategy for encouraging product selection by the user from among an array of commercial golf balls that are predominantly white.

The golf ball of the invention, which can be manufactured so as to conform with the Rules of Golf for competitive play, may be produced to a ball diameter which is not less than 42.67 mm and to a weight which is not more than 45.93 g.

EXAMPLES

The following Examples of the invention and Comparative Examples are provided by way of illustration and not by way of limitation.

Examples 1 to 5, Comparative Examples 1 to 4

In each example and comparative example below, the rubber composition shown in Table 1 was prepared, masticated in a kneader or roll mill, then fashioned into a core under specific vulcanization conditions. Next, the resin composition shown in Table 2 was injection-molded around the core with an injection mold, thereby producing a sphere composed of the core encased by an intermediate layer. The sphere was then set in a different mold and an outer cover layer material containing a specific amount of fluorescent pigment was injection-molded as shown in Table 3. Next, the cover surface was plasma treated, following which either (1) a non-yellowing urethane/acrylic resin-based paint was applied by spray painting and dried, thereby coating the cover surface with a clear paint film having a thickness of about 15 μm, or (2) a specific amount of a pearlescent pigment was blended into a non-yellowing urethane/acrylic resin-based paint resin and the resulting mixture was applied by spray painting and dried, thereby coating the cover surface with a pearlescent paint film of about the same thickness.

TABLE 1

| Core formulation | Example | | | | | Comparative Example | | | |
|---|---|---|---|---|---|---|---|---|---|
| (parts by weight) | 1 | 2 | 3 | 4 | 5 | 1 | 2 | 3 | 4 |
| Polybutadiene | 100 | 100 | 100 | 100 | 100 | 100 | 100 | 100 | 100 |
| Zinc diacrylate | 30 | 30 | 30 | 30 | 30 | 30 | 30 | 30 | 29 |
| Zinc oxide | 5 | 5 | 5 | 5 | 5 | 5 | 5 | 5 | 26.7 |
| Barium sulfate | 18.6 | 18.6 | 18.6 | 18.6 | 18.6 | 18.6 | 18.6 | 18.6 | 0 |
| Antioxidant | 0.1 | 0.1 | 0.1 | 0.1 | 0.1 | 0.1 | 0.1 | 0.1 | 0.1 |
| Zinc distearate | 5 | 5 | 5 | 5 | 5 | 5 | 5 | 5 | 0 |
| Zinc salt of pentachlorothiophenol | 0.2 | 0.2 | 0.2 | 0.2 | 0.2 | 0.2 | 0.2 | 0.2 | 0.2 |
| Peroxide | 1.2 | 1.2 | 1.2 | 1.2 | 1.2 | 1.2 | 1.2 | 1.2 | 1.2 |
| Colorant 1 | — | — | — | — | — | 0.015 | — | — | 0.08 |
| Colorant 2 | — | — | — | — | — | 0.03 | — | — | — |

Ingredient amounts shown above are in parts by weight.

The materials used in the core formulations are described below.

Polybutadiene: cis-1,4-Polybutadiene, available from JSR Corporation under the trade name "BR 730"

Zinc diacrylate: A mixture of zinc diacrylate and zinc distearate, available from Nippon Shokubai Co., Ltd.

Zinc oxide: Grade 3 zinc oxide, available from Sakai Chemical Industry Co., Ltd.

Barium sulfate: Available from Sakai Chemical Industry Co., Ltd. under the trade name "Precipitated Barium Sulfate #100"

Antioxidant: Available from Ouchi Shinko Chemical Industry Co., Ltd. under the trade name "Nocrac NS-6"

Zinc distearate: Available from NOF Corporation under the trade name "Zinc Stearate G"

Zinc salt of pentachlorothiophenol: Zhejiang Cho & Fu Chemical Co., Ltd. (China)

Peroxide: Perhexa C-40, available from NOF Corporation

Colorant 1: Resino Red K-50% LB, available from Resino Color Industry Co., Ltd.

Colorant 2: Resino Green GBA-50% LB, available from Resino Color Industry Co., Ltd.

TABLE 2

| Cover (intermediate layer) | | Example | | | | | Comparative Example | | | |
|---|---|---|---|---|---|---|---|---|---|---|
| formulation | | 1 | 2 | 3 | 4 | 5 | 1 | 2 | 3 | 4 |
| Himilan 1605 | | 50 | 50 | 50 | 50 | 50 | 50 | 50 | 50 | — |
| Himilan 1706 | | 35 | 35 | 35 | 35 | 35 | 35 | 35 | 35 | — |
| Himilan 1557 | | 15 | 15 | 15 | 15 | 15 | 15 | 15 | 15 | — |
| Surlyn 6320 | | — | — | — | — | — | — | — | — | 60 |
| Nucrel 035C | | — | — | — | — | — | — | — | — | 40 |
| Titanium oxide | | — | — | — | 2.5 | — | — | 2.5 | — | 4.1 |
| Magnesium distearate | | — | — | — | — | — | — | — | — | 70 |
| Magnesium oxide | | — | — | — | — | — | — | — | — | 0.8 |
| Color tone in intermediate | L | 51.0 | 51.0 | 51.0 | 96.9 | 51.0 | 41.5 | 51.0 | 51.0 | 91.5 |
| layer-covered sphere | a | −0.3 | −0.3 | −0.3 | −0.7 | −0.3 | 7.3 | −0.3 | −0.3 | −0.4 |
| (core + intermediate layer) | b | 1.2 | 1.2 | 1.2 | 1.2 | 1.2 | 2.1 | 1.2 | 1.2 | 2.6 |
| state (measurement area | | | | | | | | | | |
| diameter, 5 mm) | | | | | | | | | | |

Ingredient amounts shown above are in parts by weight.

The following materials were used in formulating the intermediate layer.

Himilan 1605: A sodium-neutralized ethylene-methacrylic acid available under this trade name from DuPont-Mitsui Polychemicals Co., Ltd.

Himilan 1706: A zinc-neutralized ethylene-methacrylic acid available under this trade name from DuPont-Mitsui Polychemicals Co., Ltd.

Himilan 1557: A zinc-neutralized ethylene-methacrylic acid copolymer available under this trade name from DuPont-Mitsui Polychemicals Co., Ltd.

Surlyn 6320: A magnesium-neutralized ethylene-methacrylic acid-acrylic acid ester copolymer available under this trade name from E.I. DuPont de Nemours & Co.

Nucrel 035C: An ethylene-methacrylic acid-acrylic acid ester copolymer available under this trade name from DuPont-Mitsui Polychemicals Co., Ltd.

Titanium oxide: Available from Ishihara Sangyo Kaisha, Ltd. under the trade name "Tipaque R550"

Magnesium distearate: Available from NOF Corporation under the trade name "Magnesium Stearate G"

Magnesium oxide: Available from Kyowa Chemical Industry Co., Ltd.

Himilan 1855: A zinc-neutralized ethylene-methacrylic acid-acrylic acid ester copolymer available under this trade name from DuPont-Mitsui Polychemicals Co., Ltd.

Polyethylene wax: Available from Sanyo Chemical Industries, Ltd. under the trade name "Sanwax 161P."

Titanium oxide: Available from Ishihara Sangyo Kaisha, Ltd. under the trade name "Tipaque R550."

Magnesium distearate: Available from NOF Corporation under the trade name "Magnesium Stearate G."

Magnesium oxide: Available from Kyowa Chemical Industry Co., Ltd.

The physical properties, initial velocity, spin performance on approach shots, scuff resistance, visibility, luxury and brightness of golf balls fabricated as described above were rated according to the following criteria.

Ball Deflection

The deflection (mm) of the ball when compressed under a final load of 1,275 N (130 kgf) from an initial load state of 98 N (10 kgf) was measured.

Initial Velocity

The initial velocity was measured using an initial velocity measuring apparatus of the same type as the USGA drum rotation-type initial velocity instrument approved by the R&A. The ball was held isothermally at a temperature of 23±1° C. for at least 3 hours, then tested in a room temperature (23±2° C.) chamber. The ball was hit using a 250-pound (113.4 kg) head (striking mass) at an impact velocity of 143.8 ft/s (43.83 m/s). A dozen balls were each hit four times. The time taken for the balls to traverse a distance of 6.28 ft (1.91 m) was measured and used to compute the initial velocity. This cycle was carried out over a period of about 15 minutes.

Spin on Approach Shot

The spin rate (rpm) of the ball when struck at a head speed of 20 m/s with the Tour Stage X-Wedge (loft angle, 58°) sand wedge (manufactured by Bridgestone Sports Co., Ltd.) mounted on a golf swing robot was measured.

Scuff Resistance of Ball

Golf balls were held at a temperature of 23° C., 13° C. or 0° C. and the respective balls were hit at a head speed of 33 m/s using a pitching wedge mounted on a swing robot machine, following which damage from the impact was visually rated according to the following criteria.

TABLE 3

| | | Example | | | | | Comparative Example | | | |
|---|---|---|---|---|---|---|---|---|---|---|
| | | 1 | 2 | 3 | 4 | 5 | 1 | 2 | 3 | 4 |
| Cover (formulation) | Pandex T8290 | 75 | 75 | 75 | 75 | 75 | 75 | 75 | 75 | — |
| | Pandex T8283 | 25 | 25 | 25 | 25 | 25 | 25 | 25 | 25 | — |
| | Polyisocyanate compound | 8 | 8 | 8 | 8 | 8 | 8 | 8 | 8 | — |
| | Thermoplastic elastamer | 15 | 15 | 15 | 15 | 15 | 15 | 15 | 15 | — |
| | Himilan 1557 | — | — | — | — | — | — | — | — | 75 |
| | Himilan 1855 | — | — | — | — | — | — | — | — | 25 |
| | Polyethylene wax | 1 | 1 | 1 | 1 | 1 | 1 | 1 | 1 | — |
| | Titanium oxide | — | — | — | — | — | — | — | 3.5 | — |
| | Magnesium distearate | — | — | — | — | — | — | — | — | 69 |
| | Magnesium oxide | — | — | — | — | — | — | — | — | 0.8 |
| | Ultramarine | — | — | — | — | — | — | — | 0.4 | — |
| | Orange organic fluorescent pigment | 1.6 | — | — | 1.6 | 1.6 | 1.6 | — | — | — |
| | Pink organic fluorescent pigment | — | 0.8 | — | — | — | — | — | — | — |
| | Yellow organic fluorescent pigment | — | — | 0.8 | — | — | — | — | — | — |
| | Yellow organic fluorescent dye | — | — | — | — | — | — | 0.09 | — | 0.09 |
| | Calcium carbonate | — | — | — | — | — | — | 1.5 | — | 1.5 |
| Paint coat (type) | | pearl | pearl | pearl | pearl | clear | pearl | clear | clear | clear |

Ingredient amounts shown above are in parts by weight. In the table, "pearl" stands for pearlescent.

The following materials were used in formulating the outermost layer.

Pandex T8290: MDI-PTMG type thermoplastic polyurethane material available under this trade name from DIC Bayer Polymer, Ltd. Resin hardness (Shore A), 93. Impact resilience, 52%.

Pandex T8283: MDI-PTMG type thermoplastic polyurethane material available under this trade name from DIC Bayer Polymer, Ltd. Resin hardness (Shore A), 83. Impact resilience, 55%.

Polyisocyanate compound: 4,4'-Diphenylmethane diisocyanate

Thermoplastic elastomer: A polyester thermoplastic elastomer available from DuPont-Toray Co., Ltd. under the trade name "Hytrel 4001"

Himilan 1557: A zinc-neutralized ethylene-methacrylic acid copolymer available under this trade name from DuPont-Mitsui Polychemicals Co., Ltd.

5: No damage whatsoever or substantially free of apparent damage.
4: Slight damage is apparent, but of minimal concern.
3: Surface is somewhat frayed.
2: Surface is frayed and damaged dimples are apparent.
1: Some dimples are completely obliterated.

Ball Color

The ball color was measured using a color difference meter (model SC-P, manufactured by Suga Test Instruments Co., Ltd.) according to JIS Z 8722 ("Method of Measuring the Color of a Reflecting Object") with a d/8 system (diffused illumination, receiving optics with 8° viewing angle: Condition c) while excluding specularly reflected component from the sample with light trap. The measurement area diameters used were 30 mm and 5 mm.

Ball Color Change Test

Using a mercury vapor lamp for color fading tests (H400-F, manufactured by Toshiba Corporation), ball color change tests were carried out at a light source to ball distance of 30 cm and a drum rate of rotation of 1 rpm. The surface of the ball was irradiated with the mercury vapor lamp for 24 hours. The change in color at the ball surface before and after irradiation was measured using a color difference meter (SC-P, manufactured by Suga Test Instruments Co., Ltd.). Based on the Lab color system described in JIS Z 8701, the difference in color ΔE of the ball before and after irradiation was determined. A smaller color difference ΔE value indicates less discoloration. In addition, using the same testing device, discoloration in terms of yellowing (ΔYI) before and after irradiation was examined. A larger numerical value indicates greater yellowing.

Visibility

Sensory evaluations based on the following criteria were carried out by ten skilled golfers.

Excellent: Eight or more of the 10 golfers thought the ball was easy to see on turf
Good: Five to seven of the 10 golfers thought the ball was easy to see on turf
Fair: Three or four of the 10 golfers thought the ball was easy to see on turf
NG: Two or fewer of the 10 golfers thought the ball was easy to see on turf Luxury Sensory evaluations based on the following criteria were carried out by ten skilled golfers.

Excellent: Eight or more of the 10 golfers thought the ball had a luxury
Good: Five to seven of the 10 golfers thought the ball had a luxury
Fair: Three or four of the 10 golfers thought the ball had a luxury
NG: Two or fewer of the 10 golfers thought the ball had a luxury Brightness Sensory evaluations based on the following criteria were carried out by ten skilled golfers.

Excellent: Eight or more of the 10 golfers thought the ball had a bright color
Good: Five to seven of the 10 golfers thought the ball had a bright color
Fair: Three or four of the 10 golfers thought the ball had a bright color
NG: Two or fewer of the 10 golfers thought the ball had a bright color

TABLE 4

| Ball Properties | | | Example 1 | Example 2 | Example 3 | Example 4 | Example 5 | Comparative Example 1 | Comparative Example 2 | Comparative Example 3 | Comparative Example 4 |
|---|---|---|---|---|---|---|---|---|---|---|---|
| Core diameter (mm) | | | 37.7 | 37.7 | 37.7 | 37.7 | 37.7 | 37.7 | 37.7 | 37.7 | 37.3 |
| Intermediate layer thickness (mm) | | | 1.7 | 1.7 | 1.7 | 1.7 | 1.7 | 1.7 | 1.7 | 1.7 | 1.45 |
| Outer layer thickness (mm) | | | 0.8 | 0.8 | 0.8 | 0.8 | 0.8 | 0.8 | 0.8 | 0.8 | 1.25 |
| Ball diameter (mm) | | | 42.7 | 42.7 | 42.7 | 42.7 | 42.7 | 42.7 | 42.7 | 42.7 | 42.7 |
| Ball weight (g) | | | 45.3 | 45.3 | 45.3 | 45.4 | 45.3 | 45.3 | 45.4 | 45.6 | 45.4 |
| Deflection (mm) | | | 2.7 | 2.6 | 2.6 | 2.5 | 2.6 | 2.6 | 2.5 | 2.7 | 2.9 |
| Initial velocity (m/s) | | | 77.2 | 77.2 | 77.1 | 77.1 | 77.2 | 77.2 | 77.1 | 77.3 | 77.2 |
| Spin rate on approach shots (rpm) | | | 6367 | 6358 | 6336 | 6353 | 6402 | 6354 | 6408 | 6301 | 5872 |
| Scuff resistance | | 23° C. | 5 | 5 | 5 | 5 | 5 | 5 | 5 | 5 | 4 |
| | | 13° C. | 5 | 5 | 5 | 5 | 5 | 5 | 5 | 5 | 3 |
| | | 0° C. | 4 | 4 | 4 | 4 | 4 | 4 | 4 | 4 | 3 |
| Ball color | Measurement area diameter, 5 mm | L | 53.7 | 48.0 | 59.6 | 59.5 | 43.2 | 54.2 | 74.4 | 89.6 | 77.9 |
| | | a | 13.5 | 19.6 | −15.3 | 35.7 | 22.5 | 3.2 | −19.7 | −1.1 | −17.5 |
| | | b | 20.0 | −1.6 | 24.7 | 27.0 | 16.6 | 15.6 | 39.6 | −9.8 | 35.8 |
| | | YI | 84.8 | 23.7 | 56.1 | 124.5 | 106.4 | 56.1 | 76.4 | −20.1 | 76.4 |
| | Measurement area diameter, 30 mm | L | 62.8 | 56.9 | 86.7 | 66.6 | 58.6 | 58.5 | 93.9 | 89.4 | 91.5 |
| | | a | 45.7 | 51.2 | −23.9 | 59.2 | 58.9 | 16.6 | −19.4 | −1.4 | −17.5 |
| | | b | 30.8 | 0.4 | 47.7 | 34.5 | 31.6 | 21.6 | 54.8 | −9.5 | 52.6 |
| | | YI | 140.1 | 66.2 | 78.9 | 156.7 | 168.9 | 86.7 | 89.9 | −19.8 | 90.4 |
| | ΔE (between 5-mm value and 30-mm value) | | 35.2 | 33.0 | 36.5 | 25.6 | 42.3 | 15.3 | 24.7 | 0.4 | 21.6 |
| Color change tests | ΔE | | 3.2 | 4.9 | 3.2 | 3.3 | 4.5 | 3.8 | 15.0 | 4.0 | 13.0 |
| | ΔYI | | −0.6 | 8.0 | −2.3 | −1.5 | 7.3 | −0.2 | 11.9 | 6.5 | 8.9 |
| Appearance | Visibility | | Exc | Exc | Exc | Exc | Good | Fair | Good | Fair | Good |
| | Luxury | | Exc | Exc | Exc | Exc | Good | Fair | Fair | NG | Fair |
| | Brightness | | Exc | Exc | Exc | Exc | Good | Fair | Good | NG | Good |

In the golf ball of Comparative Example 1, a gray-colored core was encased by a transparent intermediate layer, which was in turn encased by a colored outer layer. As a result, the gray color of the underlying layer detracted from the visibility, luxury and brightness of the overall ball.

In the golf ball of Comparative Example 2, the use of a fluorescent dye as the colorant of the outer layer (cover) diminished the discoloration resistance (weather resistance). In addition, to a poor discoloration resistance, because the outermost paint film was applied by clear coating, the resulting ball was somewhat lacking in the luxury.

In the golf ball of Comparative Example 3, because the outermost layer was colored an opaque white with titanium oxide, when measured in accordance with JIS Z 8722, there was no colorimetric difference between the value obtained at a measurement area diameter of 5 mm and the value obtained at a measurement area diameter of 30 mm. In addition, because the paint film was applied by clear coating, the ball lacked brightness and a luxury, and also had a poor visibility.

In the golf ball of Comparative Example 4, because the outermost layer cover was made of an ionomeric material, compared with the urethane material used in the examples of the invention, the ball had a poor spin rate on approach shots and the scuff resistance was also poor. Hence, this golf ball lacked properties acceptable to skilled golfers. Also, the outermost paint film was applied by clear coating, as a result of which the ball lacked a luxury.

Japanese Patent Application No. 2009-097060 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A golf ball comprising:

a core, a cover of at least one layer encasing the core, and a coat of paint applied to a surface of an outermost layer of the cover, wherein the outermost cover layer or the coat of paint or both is colored with a fluorescent pigment, and the ball has a color tone, at a measurement area diameter of 5 mm in a method of measuring the color of a reflecting object according to JIS Z-8722, which, expressed in the Lab color system, satisfies the conditions $30 \leqq L$, $-40 \leqq a \leqq 60$, and $\leqq b \leqq 60$ and a color tone at a measurement area diameter of 30 mm, such that the color difference $\Delta E$ therebetween is greater than 10.

2. The golf ball of claim 1, wherein the fluorescent pigment in the outermost cover layer or the coat of paint or both is an orange fluorescent pigment, and the color tone of the ball, expressed in the Lab color system, satisfies the conditions $40 \leqq L$, $-10 \leqq a \leqq 60$, and $0 \leqq b \leqq 50$.

3. The golf ball of claim 1, wherein the fluorescent pigment in the outermost cover layer or the coat of paint or both is a pink fluorescent pigment, and the color tone of the ball, expressed in the Lab color system, satisfies the conditions $30 \leqq L$, $10 \leqq a \leqq 60$, and $-20 \leqq b \leqq 10$.

4. The golf ball of claim 1, wherein the fluorescent pigment in the outermost cover layer or the coat of paint or both is a yellow fluorescent pigment, and the color tone of the ball, expressed in the Lab color system, satisfies the conditions $40 \leqq L$, $-40 \leqq a \leqq 0$, and $10 \leqq b \leqq 60$.

5. The golf ball of claim 1, wherein the outermost cover layer is made of a resin selected from the group consisting of thermoset polyurethanes, thermoplastic polyurethanes and reaction injection-molded polyurethanes.

6. The golf ball of claim 5, wherein the outermost cover layer is made of a thermoplastic polyurethane.

7. The golf ball of claim 6, wherein the thermoplastic polyurethane making up the outermost cover layer includes as a component thereof an aromatic polyisocyanate.

8. The golf ball of claim 1, wherein the outermost cover layer is colored with a fluorescent pigment and is comprised of 100 parts by weight of a base resin and from 0.05 to 2.5 parts by weight of at least one type of fluorescent pigment resin.

9. The golf ball of claim 8, wherein the fluorescent pigment in the outermost cover layer is an organic fluorescent pigment obtained by coloring an amino base resin or an acrylic base resin with a dye selected from the group consisting of xanthene, acridine, quinoline, thiazole and aminoketone dyes.

10. The golf ball of claim 1, wherein the core or an intermediate spherical body comprising the core and at least one intermediate cover layer encasing the core and positioned between the core and the outermost cover layer is either a white colored sphere or a white colored sphere encased by a clear resin layer positioned between the white colored sphere and the outermost cover layer and having a thickness of from 0.5 to 2.5 mm; the core or the intermediate spherical body has a color tone, at a measurement area diameter of 5 mm, which, expressed in the Lab color system, satisfies the conditions $40 \leqq L$, $-5 \leqq a \leqq 5$, and $-5 \leqq b \leqq 5$; and the intermediate spherical body is encased by an outermost cover layer having a thickness of from 0.3 to 2.0 mm.

11. The golf ball of claim 1, wherein the core or an intermediate spherical body comprising the core and at least one intermediate cover layer encasing the core and positioned between the core and the outermost cover layer is either a sphere colored the similar color as the outermost cover layer or coat of paint colored by the fluorescent pigment or a sphere colored the similar color as the outermost cover layer or coat of paint and encased by a clear resin layer positioned between the colored sphere and the outermost cover layer and having a thickness of from 0.5 to 2.5 mm; the core or the intermediate spherical body has a color tone, at a measurement area diameter of 5 mm, with a color difference $\Delta E$ relative to the color tone of the outer cover layer or coat of paint which, expressed in the Lab color system, is less than 15; and the intermediate spherical body is encased by an outermost cover layer having a thickness of from 0.3 to 2.0 mm.

12. The golf ball of claim 1 which has a change in color $\Delta E$ after 24 hours of irradiation with a mercury vapor lamp of at most 8.

13. The golf ball of claim 1 which has a discoloration difference ($\Delta YI$), based on the reflection method of JIS-K7103, before and after 24 hours of irradiation with a mercury vapor lamp, of at least $-10$ but not more than 10.

14. The golf ball of claim 1, wherein the coat of paint applied to the outermost layer is comprised of 100 parts by weight of a base resin composition and from 0.1 to 10 parts by weight of a polarizing pigment.

15. The golf ball of claim 1, wherein the coat of paint applied to the outermost layer is comprised of 100 parts by weight of a base resin composition and from 0.2 to 8 parts by weight of a polarizing pigment.

* * * * *